US012018416B2

(12) United States Patent
Yamanashi et al.

(10) Patent No.: US 12,018,416 B2
(45) Date of Patent: Jun. 25, 2024

(54) NON-TRANSITORY COMPUTER READABLE STORAGE MEDIUM AND SEWING MACHINE

(71) Applicant: BROTHER KOGYO KABUSHIKI KAISHA, Nagoya (JP)

(72) Inventors: Yoko Yamanashi, Konan (JP); Masashi Tokura, Nagoya (JP); Takafumi Naka, Ama (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 57 days.

(21) Appl. No.: 17/704,573

(22) Filed: Mar. 25, 2022

(65) Prior Publication Data

US 2022/0316115 A1 Oct. 6, 2022

(30) Foreign Application Priority Data

Mar. 31, 2021 (JP) ..... 2021-059069

(51) Int. Cl.
*D05B 19/10* (2006.01)
*D05C 5/02* (2006.01)

(52) U.S. Cl.
CPC ..... *D05B 19/10* (2013.01); *D05C 5/02* (2013.01)

(58) Field of Classification Search
CPC ..... D05B 19/10; D05B 19/12; D05C 5/02
See application file for complete search history.

(56) References Cited

U.S. PATENT DOCUMENTS

2006/0137583 A1 6/2006 Kato et al.
2016/0031108 A1* 2/2016 Bailie ..... B26D 5/005 700/134
2017/0190069 A1* 7/2017 Yamamoto ..... B26D 5/20
2018/0298535 A1* 10/2018 Kamihira ..... D05B 19/08

FOREIGN PATENT DOCUMENTS

JP H05-123466 A 5/1993
JP 2006-180975 A 7/2006

* cited by examiner

*Primary Examiner* — Nathan E Durham
(74) *Attorney, Agent, or Firm* — Oliff PLC

(57) ABSTRACT

A sewing machine acquires embroidery data of the embroidery pattern formed from a plurality of partial patterns. The sewing machine selects, as a selected partial pattern, at least one partial pattern from among the plurality of partial patterns forming the embroidery pattern, on the basis of the acquired embroidery data. The sewing machine identifies, on the basis of the embroidery data, an outline of the selected partial pattern that was selected. The sewing machine generates processing data for performing processing following the shape of the selected partial pattern, on the basis of the identified outline.

14 Claims, 12 Drawing Sheets

FIG. 4

EMBROIDERY DATA D1

| SEWING ORDER:1 | SEWING ORDER:2 | SEWING ORDER:3 |
|---|---|---|
| THREAD COLOR:BROWN | THREAD COLOR:RED | THREAD COLOR:GREEN |
| COORDINATE DATA (PARTIAL PATTERNS 51) | COORDINATE DATA (PARTIAL PATTERNS 52) | COORDINATE DATA (PARTIAL PATTERNS 53) |

FIG. 6

EMBROIDERY DATA D2

| SEWING ORDER:1 | SEWING ORDER:2 | SEWING ORDER:3 |
|---|---|---|
| PROCESSING DATA (OUTLINES La, Lb) | SECOND SEWING DATA (POSITIONING MARKERS 57A, 57B) | FIRST SEWING DATA (STITCH 58) |
| PROHIBIT FLAG:1 | PROHIBIT FLAG:0 | PROHIBIT FLAG:0 |

| SEWING ORDER:4 | SEWING ORDER:5 | SEWING ORDER:6 |
|---|---|---|
| THREAD COLOR:BROWN | THREAD COLOR:RED | THREAD COLOR:GREEN |
| COORDINATE DATA (PARTIAL PATTERNS 51) | COORDINATE DATA (PARTIAL PATTERNS 52) | COORDINATE DATA (PARTIAL PATTERNS 53) |
| PROHIBIT FLAG:0 | PROHIBIT FLAG:1 | PROHIBIT FLAG:0 |

NON-TRANSITORY COMPUTER READABLE STORAGE MEDIUM AND SEWING MACHINE

CROSS-REFERENCE TO RELATED APPLICATIONS

This application claims priority to Japanese Patent Application No. 2021-059069, filed Mar. 31, 2021. The disclosure of the foregoing application is incorporated herein by reference in its entirety.

BACKGROUND

The present disclosure relates to a non-transitory computer readable storage medium and a sewing machine.

An overedging sewing machine drives a motor or the like on the basis of pattern data to form embroidering in which a pattern is embroidered. If edge cutting is enabled, a user replaces a sewing needle attached to a needle bar, with a knife needle. With the knife needle attached to the needle bar, the overedging sewing machine drives the motor or the like on the basis of edge data and cuts the outline of the embroidering with the knife needle. However, if edge cutting is disabled, then with the sewing needle attached to the needle bar, the overedging sewing machine drives the motor or the like on the basis of the edge data and performs overedging following the outline of the embroidering.

SUMMARY

The overedging sewing machine executes cutting or overedging of the embroidering on the basis of edge data for performing processing following the outline of the embroidering. Therefore, only the entire embroidering is executed, i.e., it is not possible to process only part of the embroidering.

The object of the present disclosure is to provide a non-transitory computer readable storage medium that stores a command for generating data for processing only part of a pattern, and a sewing machine.

Various embodiments herein provide a non-transitory computer readable storage medium storing computer readable instructions that are executed by a processor. The computer readable instructions perform processes including an acquisition process, a selection process, an identification process and a first generation process. The acquisition process acquires embroidery data of an embroidery pattern formed from a plurality of partial patterns. The selection process selects, as a selected partial pattern, at least one partial pattern from among the plurality of partial patterns forming the embroidery pattern, on the basis of the embroidery data acquired by the acquisition process. The identification process identifies, on the basis of the embroidery data, an outline of the selected partial pattern selected by the selection process. The first generation process generates processing data for performing processing following the shape of the selected partial pattern, on the basis of the outline identified by the identification process.

Various embodiments also provide a sewing machine sewing an embroidery pattern onto an object to be sewn. The sewing machine includes a processor and a memory. The memory is configured to store computer readable instructions that, when executed by the processor, instruct the processor to perform processes. The processor acquires embroidery data of the embroidery pattern formed from a plurality of partial patterns. The processor selects, as a selected partial pattern, at least one partial pattern from among the plurality of partial patterns forming the embroidery pattern, on the basis of the acquired embroidery data. The processor identifies, on the basis of the embroidery data, an outline of the selected partial pattern that was selected. The processor generates processing data for performing processing following the shape of the selected partial pattern, on the basis of the identified outline.

Processing data for performing processing following the shape of the selected partial pattern that was selected from among the plurality of partial patterns that form the embroidery pattern is generated based on the outline of the selected partial pattern. Therefore, processing data for processing part of the embroidery pattern can be generated.

BRIEF DESCRIPTION OF THE DRAWINGS

Embodiments of the disclosure will be described below in detail with reference to the accompanying drawings in which:

FIG. 4 is a view of embroidery data;

FIG. 6 is a view of embroidery data;

DETAILED DESCRIPTION

A system 1 according to the present disclosure will be described with reference to the drawings. The drawings that are referenced are used to illustrate the technical characteristics that can be employed by the present disclosure. The configurations and the like of the devices that are described are not intended to be limited thereto, but are merely illustrative examples.

Outline of the System 1

Figure 1:
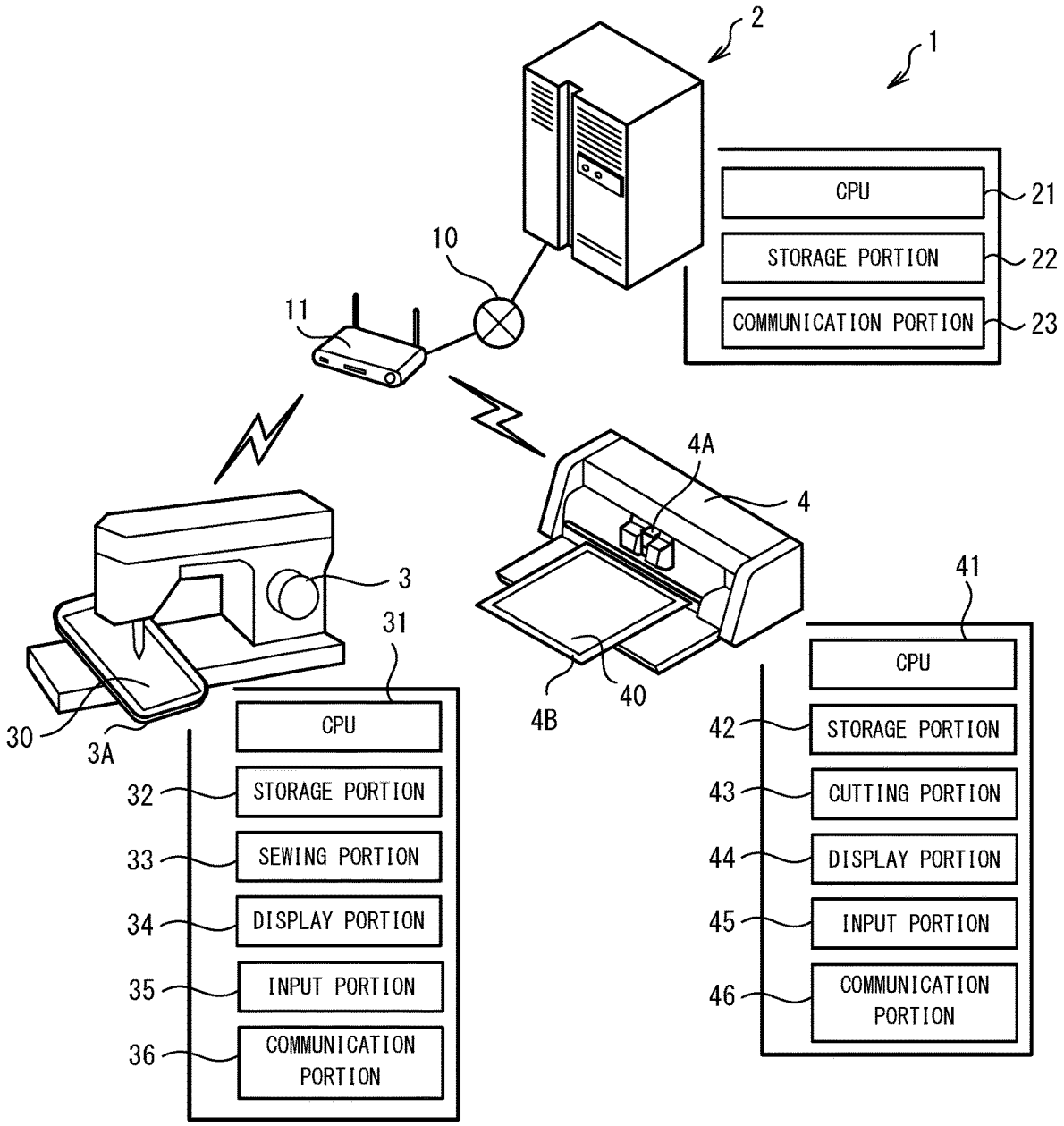
FIG. 1 is a view of an outline of a system.

An outline of the system 1 will be described with reference to FIG. 1. The system 1 has a server device 2, a sewing machine 3, and a cutting device 4. The server device 2 communicably connects to an access point 11 via a network line 10. The sewing machine 3 and the cutting device 4 both communicably connect wirelessly to the access point 11. Therefore, the server device 2, the sewing machine 3, and the cutting device 4 are able to communicate with each another via the network line 10 and the access point 11.

The server device 2 has a CPU 21, a storage portion 22, and a communication portion 23. The CPU 21 is responsible for overall control of the server device 2. A server program to be executed by the CPU 21, and embroidery data and cutting data and the like, which will be described later, are stored in the storage portion 22. The communication portion 23 is a communication module for performing communication with the sewing machine 3 and the cutting device 4 via the network line 10 and the access point 11.

The sewing machine 3 has a function of sewing an embroidery pattern onto an object 30 to be sewn. The sewing machine 3 has a CPU 31, a storage portion 32, a sewing portion 33, a display portion 34, an input portion 35, and a communication portion 36. A sewing program to be executed by the CPU 31, and embroidery data for sewing the embroidery pattern are stored in the storage portion 32 and the like. The sewing portion 33 has an upper shaft drive portion and an embroidery frame movement portion. The upper shaft drive portion reciprocally drives a sewing needle connected to a needle bar, not shown in the drawings, up and down. The embroidery pattern movement portion moves an embroidery frame 3A that holds the object 30 to be sewn. The CPU 31 controls the sewing portion 33 on the basis of the sewing data stored in the storage portion 32 and simultaneously drives the upper shaft drive portion and the embroidery frame movement portion so as to sew the embroidery pattern on the object 30 to be sewn that is held by the embroidery frame 3A.

The display portion 34 is a liquid crystal display. The input portion 35 is a touch panel provided on the surface of the display portion 34. The communication portion 36 is a communication module for communicating with the server device 2 via the network line 10 and the access point 11.

The cutting device 4 cuts an object 40 to be cut, using a cutting blade of a cartridge 4A. The cutting device 4 has a CPU 41, a storage portion 42, a cutting portion 43, a display portion 44, an input portion 45, and a communication portion 46. The CPU 41 is responsible for the overall control of the cutting device 4. A cutting program to be executed by the CPU 41, embroidery data, and cutting data for cutting the object 40 to be cut, and the like are stored in the storage portion 42. The cutting portion 43 has a conveyance mechanism, a first movement mechanism, and a second movement mechanism. The conveyance mechanism conveys, in a sub-scanning direction, a holding frame 4B that holds the object 40 to be cut on an upper surface thereof. The first movement mechanism moves the cartridge 4A in a main scanning direction. The second movement mechanism moves the cartridge 4A in an up-down direction orthogonal to the main scanning direction and the sub-scanning direction. The CPU 41 controls the cutting portion 43 in the following manner on the basis of the embroidery data or cutting data stored in the storage portion 42. The CPU 41 controls the second movement mechanism to move the cartridge 4A downward such that the cutting blade and the object 40 to be cut come into contact with one another. In this state, the CPU 41 controls the conveyance mechanism and the first movement mechanism to move the holding frame 4B and the cartridge 4A. As a result, the cutting blade moves relative to the object 40 to be cut in the main scanning direction and the sub-scanning direction, and cuts the object 40 to be cut.

The display portion 44 is a liquid crystal display. The input portion 45 is a touch panel provided on the surface of the display portion 44. The communication portion 46 is a communication module for communicating with the server device 2 via the network line 10 and the access point 11.

Embroidery Pattern 5 and Embroidery Data D1

Figure 2A:
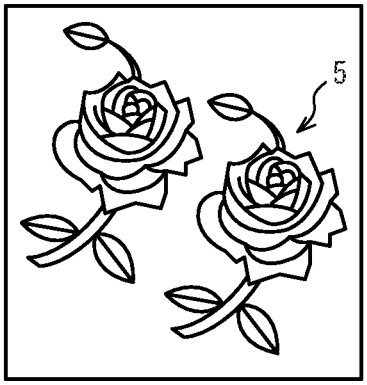
FIG. 2A to FIG. 2D are views of an embroidery pattern and a plurality of partial patterns.
Figures 2B, 2C, 2D:
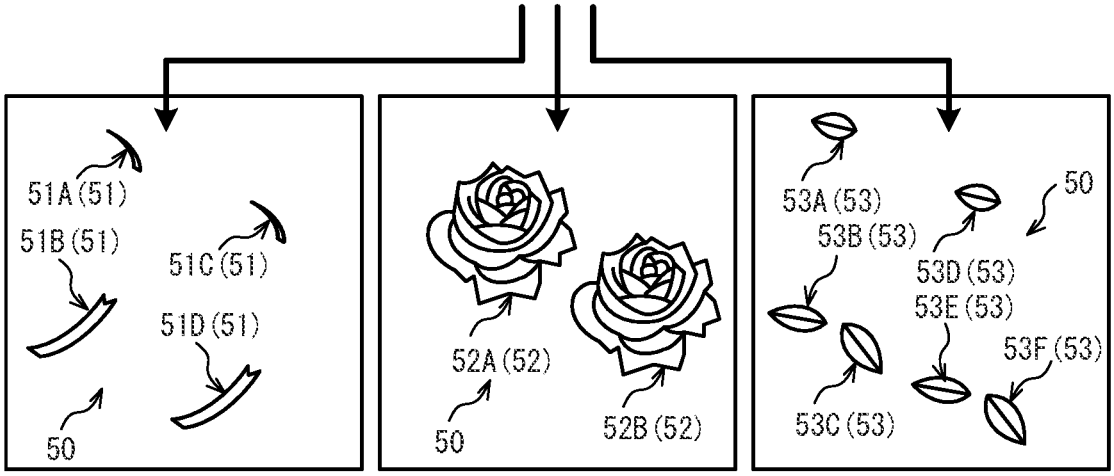

The embroidery pattern to be sewn on the basis of the embroidery data will be described using a specific example. As illustrated in FIG. 2A, an embroidery pattern 5 is formed by partial patterns 51A to 51D, 52A, 52B, and 53A to 53F (refer to FIG. 2B to FIG. 2D) divided by the color of the sewing thread (hereinafter, referred to as "thread color") used when the embroidery pattern is sewn. The partial patterns 51A to 51D illustrated in FIG. 2B represent stems and are sewn using brown sewing thread. The partial patterns 52A and 52B illustrated in FIG. 2C represent petals and are sewn using red sewing thread. The partial patterns 53A to 53F illustrated in FIG. 2D represent leaves and are sewn using green sewing thread. Hereinafter, the partial patterns 51A to 51D will be referred to as "partial patterns 51" unless otherwise specified. The partial patterns 52A and 52B will be referred to as "partial patterns 52" unless otherwise specified. The partial patterns 53A to 53F will be referred to as "partial patterns 53" unless otherwise specified. The partial patterns 51 to 53 will be collectively referred to as "plurality of partial patterns 50".

Figures 3A, 3B, 3C:
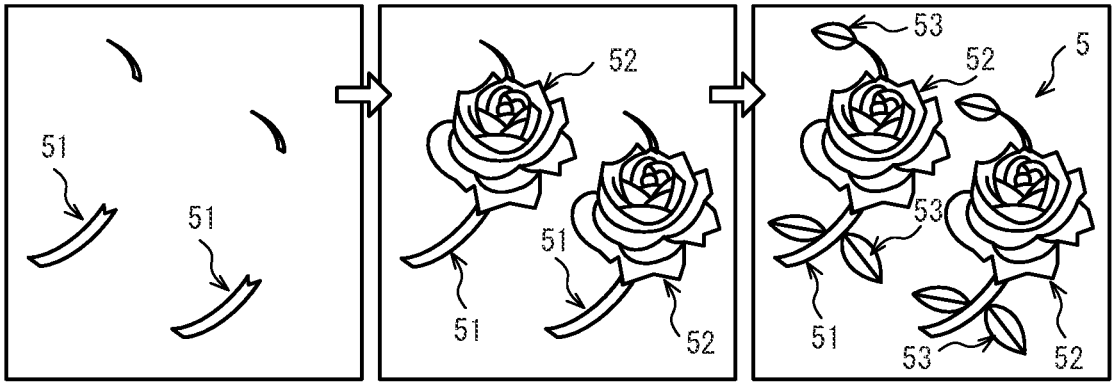
FIG. 3A to FIG. 3C are views of a process in which partial patterns are sewn in order.

The embroidery data prescribes coordinate data (hereinafter, referred to as "needle drop coordinate data") indicating the position of the needle drop point, and the sewing order and thread color for each of the plurality of partial patterns 50. As illustrated in FIG. 3A to 3C, a case in which the partial patterns 51 (refer to FIG. 3A), 52 (refer to FIG. 3B), and 53 (refer to FIG. 3C) are sewn in order while the thread color of the sewing thread is changed in order from "brown to red to green" such that the embroidery pattern 5 is ultimately formed on the object 30 to be sewn, will be given as an example. FIG. 4 schematically shows the needle drop coordinate data, thread color, and sewing order prescribed by embroidery data D1 for performing such sewing. In the embroidery data D1, "brown" is set as the thread color and "1" is set as the sewing order for the needle drop coordinate data for sewing the partial patterns 51. "Red" is set as the thread color and "2" is set as the sewing order for the needle drop coordinate data for sewing the partial patterns 52. "Green" is set as the thread color and "3" is set as the sewing order for the needle drop coordinate data for sewing the partial patterns 53. The "coordinate data" in the drawings indicates the "needle drop coordinate data".

Outline of the Sewing Machine 3

Figure 5A:
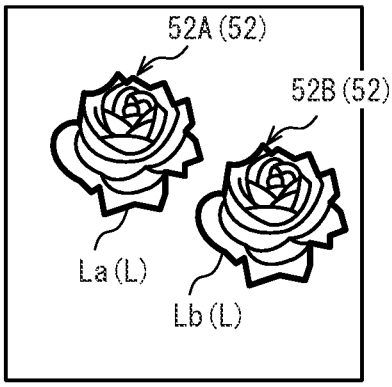
FIG. 5A to FIG. 5D are views of partial pattern outlines, pieces, positioning markers, and stitches.

The sewing machine 3 has a function of replacing at least one of the plurality of partial patterns 50 included in the embroidery pattern 5 with cloth or the like different from the object 30 to be sewn, and sewing. For example, a case in which the partial patterns 52 in FIG. 2C are replaced with another cloth or the like and sewn will be described in detail. In this case, the sewing machine 3 generates processing data (refer to FIG. 5B), second sewing data (refer to FIG. 5C), and first sewing data (refer to FIG. 5D) from the needle drop coordinate data of the partial patterns 52 illustrated in FIG. 5A.

Figure 5B:
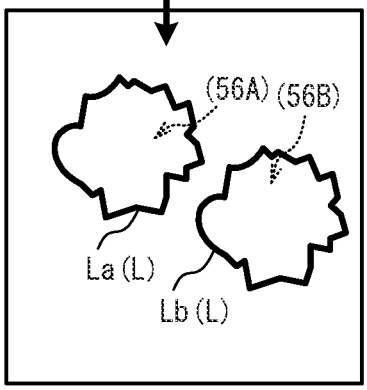

As illustrated in FIG. 5B, the processing data is data for the cutting device 4 to cut the object 40 to be cut following the shapes of the partial patterns 52A and 52B on the basis of outlines La and Lb (refer to FIG. 5A) of the outer shape of the partial patterns 52A and 52B, respectively. The processing data is coordinate data indicative of the outlines La and Lb of the outer shapes of the partial patterns 52A and 52B, respectively. The cutting device 4 can cut, from the object 40 to be cut, a piece 56A having the shape of the partial pattern 52A, and a piece 56B having the shape of the partial pattern 52B, by being driven on the basis of the processing data. Hereinafter, the outlines La and Lb will be collectively referred to as "outlines L" unless otherwise specified.

Note that the sewing machine 3 can also perform sewing on the basis of the processing data. For example, the sewing machine 3 identifies the needle drop position and executes sewing on the basis of the processing data. When the sewing machine 3 performs sewing based on the processing data, the stitching pattern indicating the outlines L of the partial patterns 52 is sewn on the object 30 to be sewn. Hereinafter, this kind of pattern will be referred to as "outline pattern". For example, a user can create the pieces 56A and 56B without using the cutting device 4, by cutting the object 30 to be sewn using scissors or the like following the outline patterns that have been sewn. In this case, the user replaces the object 30 to be sewn from which the pieces 56A and 56B have been cut with another object 30 to be sewn. In this state, the sewing machine 3 can perform the sewing shown in FIGS. 5C and 5D, which will be described later, on the object 30 to be sewn after the object 30 to be sewn has been replaced.

Figure 5C:
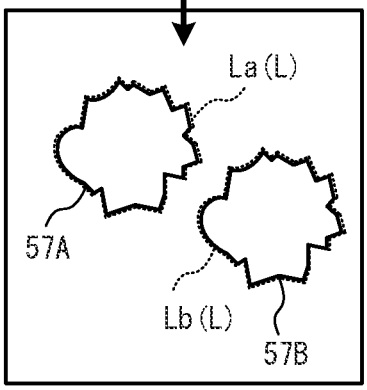

As illustrated in FIG. 5C, the second sewing data is data for the sewing machine 3 to sew positioning markers 57A and 57B to be used for positioning, which indicate the positions in which the pieces 56A and 56B are to be sewn onto the object 30 to be sewn. The positioning markers 57A and 57B have shapes approximately 0.5 mm away from, to the inside of, the outlines La and Lb of the partial patterns 52A and 52B.

Figure 5D:
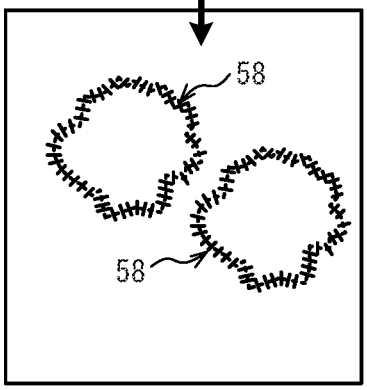

As illustrated in FIG. 5D, the first sewing data is data for the sewing machine 3 to sew an overcast stitch or the like (hereinafter referred to as "stitch 58") for sewing the pieces 56A and 56B to the object 30 to be sewn.

After generating the processing data, the second sewing data, and the first sewing data, the sewing machine 3 adds the generated processing data, the second sewing data, and the first sewing data to the original embroidery data D1 to create embroidery data D2 (refer to FIG. 6). Moreover, the sewing machine 3 sets the sewing order of sewing based on the needle drop coordinate data, the processing data, the second sewing data, and the first sewing data in the embroidery data D2, on the basis of the following rules (1) to (4).

(1) The sewing machine 3 sets the sewing order of sewing based on the first sewing data and the second sewing data such that the sewing of the positioning markers 57A and 57B and the stitch 58 is performed before the sewing of the partial patterns 51 and 53, excluding the partial patterns 52, from among the plurality of partial patterns 50.

(2) The sewing machine 3 sets the sewing order of sewing based on the first sewing data and the second sewing data such that the sewing of the positioning markers 57A and 57B and the stitch 58 is performed before the sewing of the partial patterns 52.

(3) The sewing machine 3 sets the sewing order of sewing based on the first sewing data and the second sewing data such that the sewing of the positioning markers 57A and 57B is performed before the sewing of the stitch 58.

(4) The sewing machine 3 sets the sewing order of the sewing based on the processing data such that the sewing of the outline patterns is performed before the sewing of the partial patterns 51 and the 53, excluding the partial patterns 52, from among the plurality of partial patterns 50.

FIG. 6 illustrates a specific example of the embroidery data D2 in which the sewing order has been set on the basis of the rules (1) to (4). "1" is set as the sewing order for the processing data. "2" is set as the sewing order for the second sewing data. "3" is set as the sewing order for the first sewing data. Also, the sewing orders set in the needle drop coordinate data for sewing the partial patterns 51, 52, and 53 are moved back, thus are set to "4", "5", and "6", respectively.

Moreover, the sewing machine 3 sets, for each type of data, a prohibit flag indicating whether to prohibit sewing based on the various data included in the embroidery data D2. In FIG. 6, sewing based on data (processing data and needle drop coordinate data (partial patterns 52)) corresponding to a prohibit flag "1" is prohibited, and sewing based on data (second sewing data, first sewing data, and needle drop coordinate data (partial patterns 51 and 53)) corresponding to a prohibit flag "0" is not prohibited. The method for setting the prohibit flag will be described later.

A first example of an operation by which the sewing machine 3 performs sewing on the basis of the embroidery data D2 illustrated in FIG. 6 will be described with reference to FIG. 7A to FIG. 7E. In the first example, it will be assumed that the pieces 56A and 56B can be cut by the cutting device 4.

The sewing machine 3 sends the embroidery data D2 (refer to FIG. 6) to the server device 2 in order to cause the cutting device 4 to cut the pieces 56A and 56B. The server device 2 receives the embroidery data D2 from the sewing machine 3 and stores the received embroidery data D2 in the storage portion 22. Also, the server device 2 sends the embroidery data D2 stored in the storage portion 22 to the cutting device 4 in response to a request from the cutting device 4. The cutting device 4 receives the embroidery data D2 sent from the server device 2. The cutting device 4 is driven on the basis of the processing data (refer to FIG. 6) of the sewing order "1" prescribed by the embroidery data D2, and cuts the pieces 56A and 56B from the object 40 to be cut.

Figure 7A:
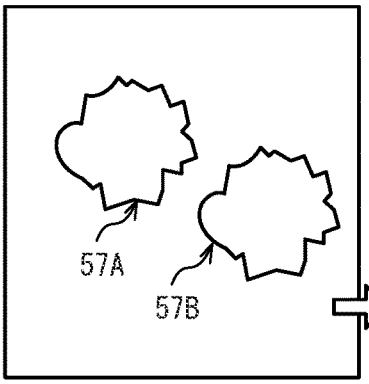
FIG. 7A to FIG. 7E are views of a first example of an embroidery operation.
Figure 7B:
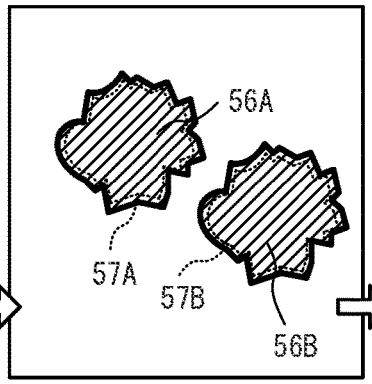

The sewing machine 3 starts sewing based on the various data (second sewing data, first sewing data, and needle drop coordinate data (partial patterns 51 and 53)) for which the prohibit flag "1" is not set, from among the various data in the embroidery data D2. First, the CPU 31 drives the sewing machine 3 on the basis of the second sewing data (refer to FIG. 6) of the sewing order "2" prescribed by the embroidery data D2, and sews the positioning markers 57A and 57B on the object 30 to be sewn, as illustrated in FIG. 7A. Next, the user, arranges the piece 56A cut by the cutting device 4 in the position indicated by the positioning marker 57A sewn onto the object 30 to be sewn, as illustrated in FIG. 7B. The user also arranges the piece 56B cut by the cutting device 4 in the position indicated by the positioning marker 57B sewn onto the object 30 to be sewn.

Figure 7C:
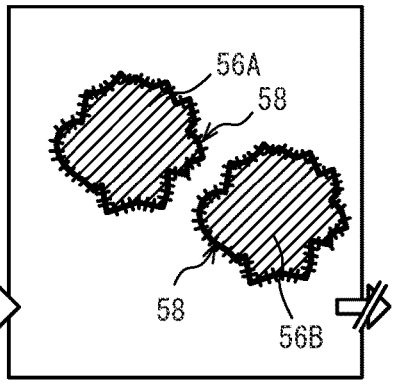

Next, the sewing machine 3 is driven on the basis of the first sewing data (refer to FIG. 6) of the sewing order "3" prescribed by the embroidery data D2, and sews the stitch 58, as illustrated in FIG. 7C. As a result, the pieces 56A and 56B are sewn onto the object 30 to be sewn.

Figure 7D:
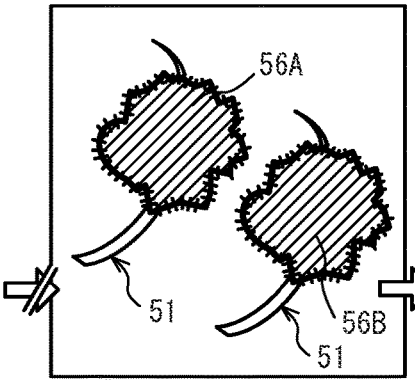
Figure 7E:
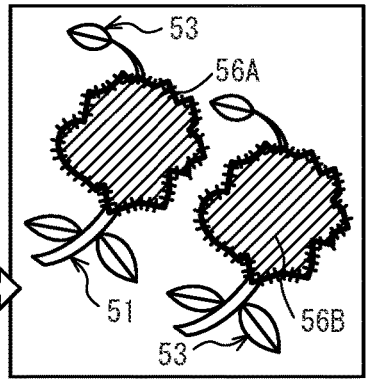

Next, the sewing machine 3 is driven on the basis of the needle drop coordinate data (refer to FIG. 6) of the sewing order "4" prescribed by the embroidery data D2, and sews the partial patterns 51 on the object 30 to be sewn onto which the pieces 56A and 56B have been sewn, as illustrated in FIG. 7D. Next, the sewing machine 3 is driven on the basis of the needle drop coordinate data (refer to FIG. 6) of the sewing order "6" prescribed by the embroidery data D2, and sews the partial patterns 53 onto the object 30 to be sewn onto which the pieces 56A and 56B and the partial patterns 51 have been sewn, as illustrated in FIG. 7E.

A second example of an operation by which the sewing machine 3 performs sewing will be described with reference to FIG. 8A to 8E. In this second example, it will be presumed that the pieces 56A and 56B cannot be cut by the cutting device 4. In this case, the sewing machine 3 sews an outline pattern onto the object 30 to be sewn on the basis of the processing data, so the prohibit flag of the processing data in the embroidery data D2 illustrated in FIG. 6 becomes "0", which differs from FIG. 6.

Figures 8A, 8B, 8C:
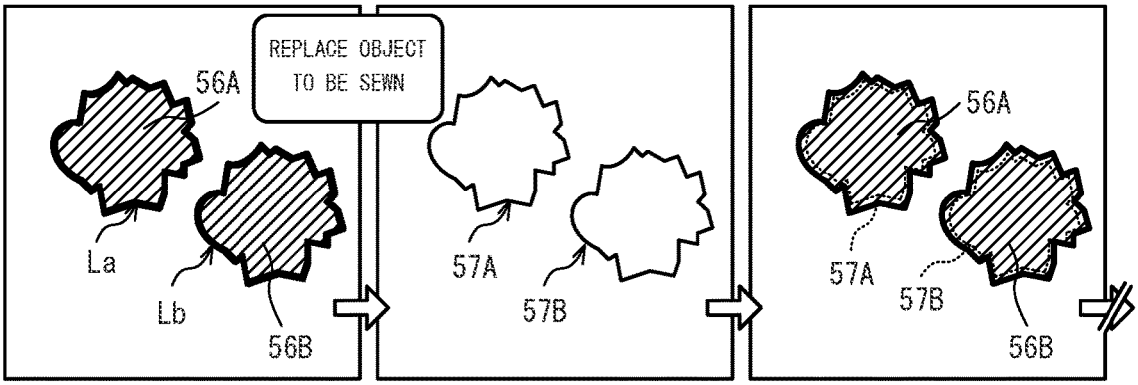
FIG. 8A to FIG. 8F are views of a second example of an embroidery operation.
Figures 8D, 8E, 8F:
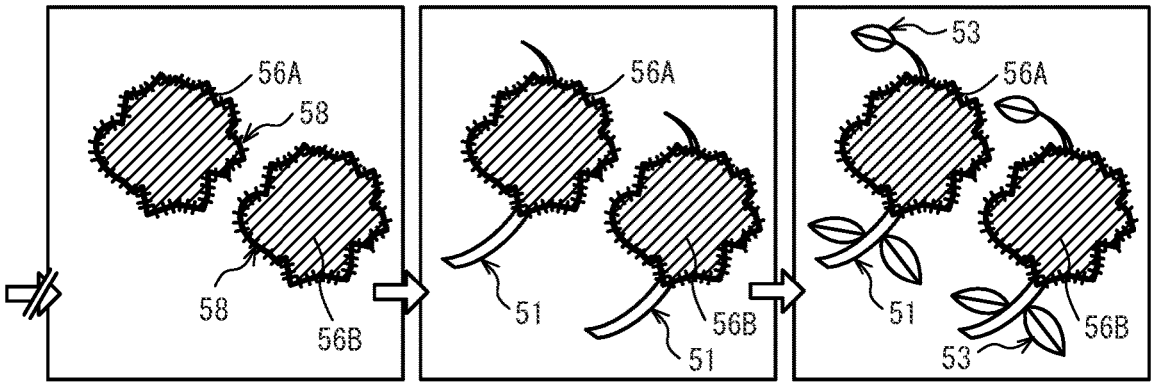

First, the sewing machine 3 sews the outline pattern onto the object 30 to be sewn on the basis of processing data for which a prohibit flag "1" is not set, of the various data in the embroidery data D2, as illustrated in FIG. 8A. Next, the user cuts the object 30 to be sewn along the sewn outline pattern, thereby creating the pieces 56A and 56B. Next, the user removes the object 30 to be sewn from which the pieces 56A and 56B have been cut, from the embroidery frame 3A of the sewing machine 3, and attaches another object 30 to be sewn to the embroidery frame 3A.

The sewing machine 3 starts sewing on the basis of various data (second sewing data, first sewing data, needle drop coordinate data (partial patterns 51 and 53)) for which the prohibit flag "1" is not set, of the various data excluding the processing data in the embroidery data D2 (FIG. 8B to FIG. 8F). FIG. 8B to FIG. 8F are the same as FIG. 7A to FIG. 7E except for the feature wherein the pieces 56A and 56B are cut out by the cutting device 4, so a description of FIG. 8B to FIG. 8F will be omitted. Therefore, the object 30 to be sewn onto which the pieces 56A and 56B created by the user, and the partial patterns 51 and 53, are sewn is obtained (refer to FIG. 8F).

Main Process

A main process executed by the CPU 31 of the sewing machine 3 will be described with reference to FIG. 9. The main process starts in response to the CPU 31 reading and executing the sewing program stored in the storage portion 32 when the user performs, via the input portion 35, an operation to specify an embroidery pattern and start sewing. In the description below, it will be presumed that the embroidery pattern 5 illustrated in FIG. 2A has been specified by the user.

Figure 10:
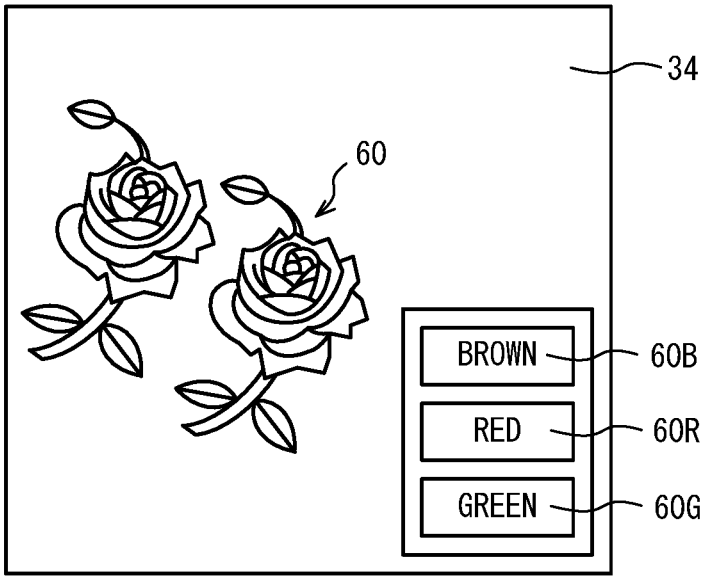
FIG. 10 is a view of a pattern image and selection buttons displayed on a display portion.

The CPU 31 reads and acquires the embroidery data D1 (refer to FIG. 4) for sewing the embroidery pattern 5 specified by the user, from among the embroidery data stored in the storage portion 32 (step S11). The CPU 31 displays, on the display portion 34, a pattern image 60 (refer to FIG. 10) showing the specified embroidery pattern 5, on the basis of the acquired embroidery data D1. Also, the CPU 31 identifies the thread color (brown, red, green) prescribed by the acquired embroidery data D1. The CPU 31 further displays, on the display portion 34, selection buttons 60B, 60R, and 60G (refer to FIG. 10) by which each of the identified thread colors can be selected. FIG. 10 shows the pattern image 60 and the selection buttons 60B, 60R, and 60G displayed on the display portion 34.

A case will be presumed in which the user has performed an operation to select the selection button 60R for selecting red as the thread color. As illustrated in FIG. 9, the CPU 31 receives the selection of red via the input portion 35. The CPU 31 identifies the needle drop coordinate data corresponding to red, which is the thread color that was received, and selects the corresponding partial patterns 52A and 52B (refer to FIG. 2C) on the basis of the embroidery data D1 acquired through the processing in step S11 (step S13).

The CPU 31 determines, on the basis of the needle drop coordinate data of the partial patterns 52 in the embroidery data D1, whether a crossover thread is included in the selected partial patterns 52A and 52B (refer to FIG. 2C) (step S15). Crossover thread is sewing thread that extends between the partial patterns 52A and 52B. A crossover thread can occur when a plurality of partial patterns that are separated from one another are sewn in sequence with sewing thread of a common thread color. If it is determined that a crossover thread is included between the partial patterns 52A and 52B (yes at step S15), the CPU 31 deletes the needle drop coordinate data related to the crossover thread from the needle drop coordinate data of the partial patterns 52 in order to reduce the outlines L including the crossover thread from being identified (step S17). The CPU 31 then moves the processing on to step S19. If, on the other hand, it is determined that a crossover thread is not included between the partial patterns 52A and the 52B (no at step S15), the CPU 31 moves the processing on to step S19.

The CPU 31 generates an image of the partial patterns 52 on the basis of the needle drop coordinate data of the partial patterns 52 in the embroidery data D1, and identifies the outlines L of the outer shapes of the partial patterns 52 (step S19). Note that the partial patterns 52A and 52B that have a common thread color of red are selected by the processing in step S13, so the CPU 31 identifies both the outline La (refer to FIG. 5B) of the partial pattern 52A and the outline Lb (refer to FIG. 5B) of the partial pattern 52B. Note that if the crossover thread is deleted in the processing in step S17, the outlines L of the portions of the partial patterns 52 excluding the crossover thread are identified.

In the description above, the CPU 31 may also generate an image of the partial patterns 52 without deleting the needle drop coordinate pattern related to the crossover thread, and identify the outlines L of the outer shapes of the partial patterns 52 including the crossover thread. The CPU 31 may then delete the portions corresponding to the outlines L of the crossover thread.

The CPU 31 generates, on the basis of the outlines La and Lb, processing data for the cutting device 4 to cut out the object 40 to be cut following the shapes of the partial patterns 52A and 52B, respectively (step S21). Note that the CPU 31 generates one piece of processing data for each thread color. Here, one piece of processing data corresponding to the partial patterns 52A and 52B is generated because the thread colors of the partial patterns 52A and 52B are the same color, i.e., red.

However, a plurality of thread colors may also be simultaneously selected by the user, for example (step S13). In this case, the CPU 31 generates, for each thread color, a plurality of pieces of processing data corresponding to the partial pattern to be sewn using sewing threads of a plurality of thread colors.

The CPU 31 generates the second sewing data for sewing the positioning markers 57A and 57B (refer to FIG. 5C), on the basis of the outlines L of the partial patterns 52 (step S23). The CPU 31 further generates the first sewing data for sewing the stitch 58 (refer to FIG. 5D), on the basis of the outlines L of the partial patterns 52 (step S23). The CPU 31 includes, in the embroidery data D1, the processing data generated by the processing in step S21 and the second sewing data and the first sewing data generated by the processing in step S23, thereby creating the embroidery data D2. Moreover, the CPU 31 sets the sewing order prescribed by the embroidery data D2, on the basis of the rules (1) to (4) (step S25; refer to FIG. 6).

In order to set the prohibit flags in the embroidery data D2 by the processing in steps S27 to S33, the CPU 31 sets the prohibit flag "0" for all of the data in the embroidery data D2, thereby initializing it. The CPU 31 determines whether communication with the server device 2 (refer to FIG. 1) is possible via the network line 10 and the access point 11 (step S27). The method for determining whether communication with the server device 2 is possible is not particularly limited. For example, the CPU 31 may determine whether communication with the server device 2 is possible by communication using a ping.

If the CPU 31 determines that communication with the server device 2 is not possible (no at step S27), the CPU 31 sets the prohibit flag "0" for the processing data in the embroidery data D2 such that sewing of the outline pattern based on the processing data will be performed by the sewing machine 3 (step S31). The reason for this is that the embroidery data D2 cannot be sent to the cutting device 4 via the server device 2, so the pieces 56A and 56B cannot be created by the cutting device 4. In this case, the sewing machine 3 sews the outline pattern onto the object 30 to be sewn on the basis of the processing data, and the pieces 56A and 56B need to be created by the user cutting them out. The CPU 31 then moves the processing on to step S33.

If the CPU 31 determines that communication with the server device 2 is possible (yes at step S27), the CPU 31 sets the prohibit flag "1" for the processing data in the embroidery data D2 such that sewing of the outline pattern based on the processing data will not be performed (step S29). The reason for this is that the embroidery data D2 can be sent to the cutting device 4 via the server device 2, so the pieces 56A and 56B can be cut out by the cutting device 4. In this case, sewing of the outline pattern based on the processing data is unnecessary. The CPU 31 then moves the processing on to step S33.

The CPU 31 sets the prohibit flag "1" for the needle drop coordinate data of the partial patterns 52 in the embroidery data D2 such that the partial patterns 52 selected by the processing in step S13 will not be sewn (step S33). The reason for this is that the partial patterns 52 are replaced by the pieces 56A and 56B, so sewing is unnecessary.

Figure 11:
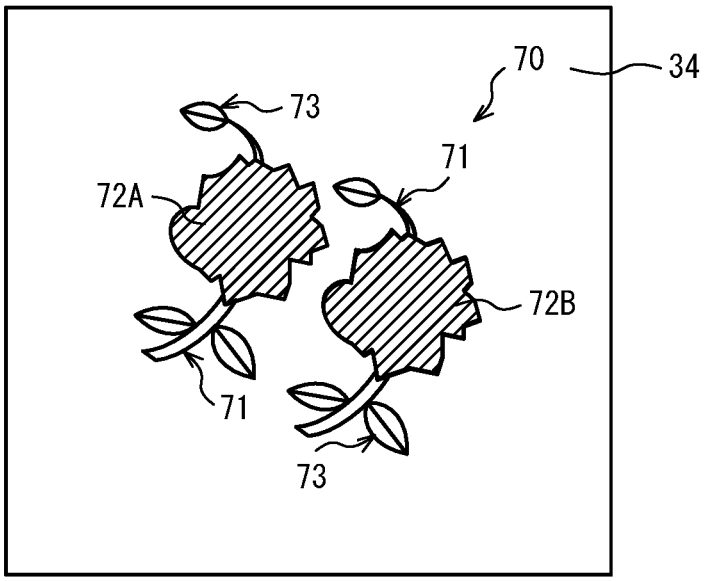
FIG. 11 is a view of a preview image displayed on the display portion.

The CPU 31 displays a preview image 70 illustrated in FIG. 11, on the display portion 34 (step S35). As illustrated in FIG. 11, the preview image 70 includes pattern images 71 and 73 as images that show the partial patterns 51 and 53 (refer to FIG. 2B and FIG. 2D), respectively, of the embroidery pattern 5 (refer to FIG. 2A). Also, in the preview image 70, the images of the partial patterns 52A and 52B (refer to FIG. 2C) of the embroidery pattern 5 are replaced by substitute images 72A and 72B. The substitute images 72A and 72B may take a form in which the portions inside the outlines La and Lb (refer to FIG. 5B) of the partial patterns 52A and 52B are uniformly filled with a single color. The color of the substitute images 72A and 72B is set to be different from the colors of the pattern images 71 and 73 so that it is possible to differentiate the substitute images 72A and 72B from the pattern images 71 and 73. Note that the color of the substitute images 72A and 72B may be set to the same color as the color of the object 40 to be cut used when the pieces 56A and 56B are cut by the cutting device 4. Also, the substitute images 72A and 72B may take any form as long as the user is able to recognize that they are the selected partial patterns. For example, the substitute images 72A and 72B may be filled with a single color as described above, or may be filled with a pattern such as hatching or dots.

Figure 9:
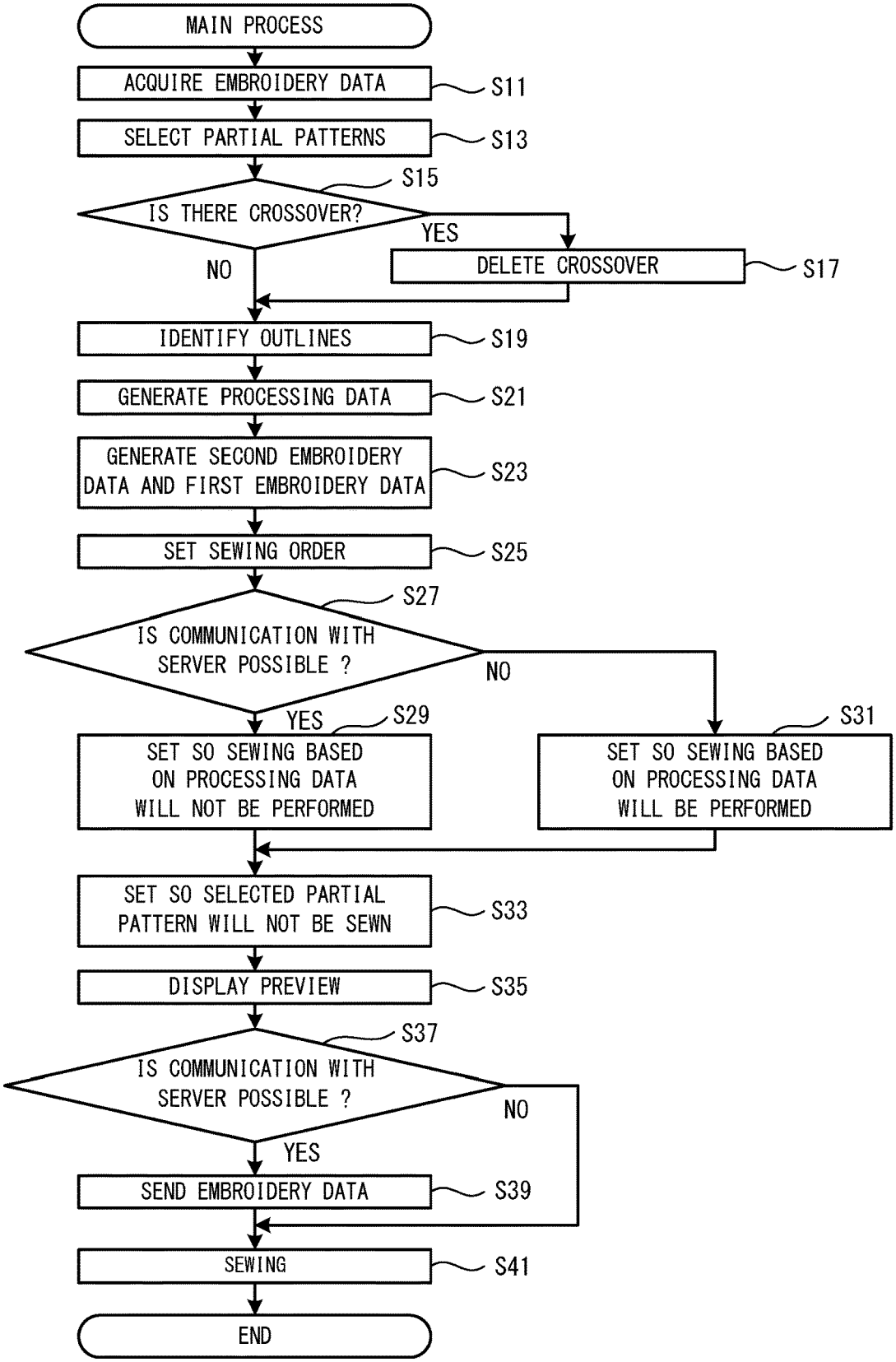
FIG. 9 is a flowchart of a main process.

As illustrated in FIG. 9, the CPU 31 determines whether communication with the server device 2 is possible by the processing in step S27 (step S37). If the CPU 31 determines that communication with the server device 2 is possible (yes at step S37), the CPU 31 sends the embroidery data D2 to the server device 2 via the network line 10 and the access point 11 (step S39). The CPU 31 then moves the processing on to step S41. If the CPU 31 determines that communication with the server device 2 is not possible (no at step S37), the CPU 31 moves the processing on to step S41.

The CPU 31 executes sewing on the basis of the embroidery data D2 (step S41). Note that if sewing based on the processing data is prohibited by the processing in step S29, sewing of the positioning markers 57A and 57B based on the second sewing data (refer to FIG. 7A) is first executed. After sewing the positioning markers 57A and 57B, the pieces 56A and 56B are arranged by the user (refer to FIG. 7B). Next, sewing of the stitch 58 based on the first sewing data (refer to FIG. 7C), and sewing of the partial patterns 51 and 53 based on the needle drop coordinate data (refer to FIG. 7D and FIG. 7E) are executed in that order.

However, if sewing based on the processing data is not prohibited by the processing in step S31, sewing of the outline pattern based on the processing data (refer to FIG. 8A) is first executed. After the pieces 56A and 56B are created by the user and the object 30 to be sewn is replaced, sewing of the positioning markers 57A and 57B based on the second sewing data (refer to FIG. 8B) is executed. After the positioning markers 57A and 57B are sewn, the pieces 56A and 56B are arranged by the user (refer to FIG. 8C). Next, sewing of the stitch 58 based on the first sewing data (refer to FIG. 8D), and sewing of the partial patterns 51 and 53 based on the needle drop coordinate data (refer to FIG. 8E and FIG. 8F) are executed in that order.

Operation and Effect of the Present Disclosure

The sewing machine 3 can generate, on the basis of the outlines L of the partial patterns 52, processing data for the cutting device 4 to cut the object 40 to be cut following the shapes of the selected partial patterns 52, from among the plurality of partial patterns 50 that form the embroidery pattern 5 (step S21). Therefore, the sewing machine 3 can generate processing data for the cutting device 4 to cut the pieces 56A and 56B indicative of the partial patterns 52 of the embroidery pattern 5.

When any of the thread colors of the sewing thread for sewing the embroidery pattern 5 is selected by the user, the sewing machine 3 selects the partial patterns 52 corresponding to the selected thread color (red) (step S13). Therefore, the sewing machine 3 can select the partial patterns 52 from the plurality of partial patterns 50 divided by the thread color of the sewing thread in the embroidery pattern 5, and generate processing data on the basis of the shapes of the partial patterns 52.

The sewing machine 3 sets the sewing order of sewing based on the first sewing data in the embroidery data D2 such that the sewing of the stitch 58 will be performed before the sewing of the partial patterns 51 and 53, excluding the partial patterns 52, from among the plurality of partial patterns 50 (step S25; refer to (1)). In this case, the sewing machine 3 can sew the partial patterns 51 and 53 after sewing the pieces 56A and 56B indicative of the partial patterns 52 onto the object 30 to be sewn with the stitch 58. As a result, the sewing machine 3 can sew the embroidery pattern 5 in which the selected partial patterns 52 have been replaced with the pieces 56A and 56B, from among the plurality of partial patterns 50 that form the embroidery pattern 5.

The sewing machine 3 sews the pieces 56A and 56B that have been arranged on the basis of the positioning markers 57A and 57B onto the object 30 to be sewn, with the stitch 58, instead of sewing the partial patterns 52. Also, with regards to the sewing order set in the embroidery data D2, the sewing machine 3 sets the sewing order corresponding to the second data for sewing the positioning markers 57A and 57B and the first sewing data for sewing the stitch 58 ahead of the sewing order corresponding to the partial patterns 52 (step S25; refer to (2)). In this case, the sewing machine 3 can set the sewing timing of the positioning markers 57A and 57B and the stitch 58 ahead of the sewing timing of the partial patterns 52 when the partial patterns 51 to 53 are to be sewn. In this case, the sewing machine 3 can nicely reproduce the same finishing as when the embroidery pattern 5 is formed by the partial patterns 51, 52, and 53 being sewn in order, even when the partial patterns 52 are replaced with the pieces 56A and 56B.

The sewing machine 3 sets the sewing order of the sewing based on the first sewing data and the second sewing data in the embroidery data D2 such that the positioning markers 57A and 57B are sewn before the stitch 58 is sewn (step S25; refer to (3)). In this case, the sewing machine 3 can sew the pieces 56A and 56B with the stitch 58 after the user has positioned the pieces 56A and 56B on the basis of the sewn positioning markers 57A and 57B.

The sewing machine 3 sets the sewing order of the sewing based on the processing data in the embroidery data D2 such that the outline patterns are sewn before the partial patterns 51 and 53, excluding the partial patterns 52, of the plurality of partial patterns 50, are sewn (step S25; refer to (4)). In this case, the sewing machine 3 can sew the outline patterns showing the outlines of the partial patterns 52 and have the user create the pieces 56A and 56B. Also, the sewing machine 3 can then sew the partial patterns 51 and 53 onto the object 30 to be sewn that has been replaced by the user. Also, if the outline patterns and the partial patterns 51 and 53 overlap, the sewing portions of the partial patterns 51 and 53 are sewn in front of the outline patterns, so it is possible to inhibit outline patterns from affecting the sewing finish of the embroidery pattern 5.

If the crossover thread is included between the partial patterns 52A and 52B (yes at step S15), the sewing machine 3 deletes the needle drop coordinate data related to the crossover thread from the needle drop coordinate data of the partial patterns 52 in order to reduce the outlines L that includes the crossover thread from being identified (step S17). The sewing machine 3 generates processing data on the basis of the outlines of the partial patterns 52 excluding the crossover thread. In this case, the sewing machine 3 can improve the appearance of the pieces 56A and 56B cut from the object 40 to be cut by the cutting device 4 on the basis of the processing data. Also, the sewing machine 3 can improve the appearance when the outline patterns are sewn on the basis of the processing data.

The sewing machine 3 can generate, all at once, processing data for identifying the outlines of the partial patterns 52A and 52B, cutting the pieces 56A and 56B with the cutting device 4, and sewing the outline patterns with the sewing machine 3, even if the partial patterns 52A and 52B are included as the partial patterns 52 corresponding to the thread color (red) selected by the user. Therefore, the sewing machine 3 can efficiently generate processing data.

The sewing machine 3 generates one piece of processing data for performing processing following the shapes of the partial patterns 52A and 52B having a sewing thread of a common thread color. That is, the sewing machine 3 generates, for each thread color, one piece of processing data corresponding to the plurality of partial patterns 50 having a common thread color (step S21). In this case, the sewing machine 3 can cause the cutting device 4 to cut, all at once, the pieces corresponding to each of the plurality of partial patterns 50 having a common thread color. Also, the sewing machine 3 can sew, all at once, the outline patterns of the plurality of partial patterns 50 having a common thread color.

The partial patterns 52 do not need to be sewn onto the object 30 to be sewn because the pieces 56A and 56B are cut out by the cutting device 4. Thus, the sewing machine 3 sets the prohibit flag in the embroidery data D2 such that the partial patterns 52 will not be sewn (step S33). Therefore, the sewing machine 3 can reduce unnecessary partial patterns 52 from being sewn onto the object 30 to be sewn.

If communication with the server device 2 is possible (yes at step S27), the sewing machine 3 sets the prohibit flag in the embroidery data D2 such that the sewing of the outline patterns based on the processing data will not be performed (step S29). Therefore, the sewing machine 3 can reduce unnecessary outline patterns from being sewn onto the object 30 to be sewn in a case where the pieces 56A and 56B have been cut out by the cutting device 4. If, on the other hand, communication with the server device 2 is not possible (no at step S27), the sewing machine 3 sets the prohibit flag in the embroidery data D2 such that the sewing of the outline patterns based on the processing data will be performed (step S31). Therefore, even if the cutting device 4 is unable to cut the pieces 56A and 56B, the pieces 56A and 56B can be created by the user cutting the object 30 to be sewn on the basis of the outline patterns.

The sewing machine 3 displays, on the display portion 34, the preview image 70 in which the partial patterns 52 of the embroidery pattern 5 have been replaced by the substitute images 72A and 72B (step S35). In this case, the user can check, with the preview image 70, the sewing mode when sewing has been performed in a state in which the partial patterns 52 have been replaced with the pieces 56A and 56B.

Modified Examples

The present disclosure is not limited to the foregoing embodiment and various modifications are possible. All or some of the processing in steps S11 to S39 of the main process may be executed by an electronic device (PC, tablet terminal, smartphone, etc.) not shown in the drawings. A CPU of the electronic device may execute all or some of the processing in steps S11 to S39 of the main process by reading and executing a data generating program stored in a storage portion of the electronic device. The data generating program may be installed on the electronic device via a communication line such as the network line 10. Alternatively, the data generating program may be installed on the electronic device by a storage medium in which the data generating program is stored being read by the electronic device. If all or some of the processing in steps S11 to S39 of the main process is executed by the electronic device, the generated embroidery data may be sent from the electronic device to the sewing machine 3 and the cutting device 4. In this case, the cutting device 4 may cut the pieces 56A and 56B on the basis of the embroidery data received from the electronic device. The sewing machine 3 may execute the processing in step S41 of the main process.

The embroidery data that the sewing machine 3 has sent to the server device 2 in step S39 may be received by another sewing machine. The other sewing machine may sew the outline patterns onto the object to be sewn, on the basis of the processing data included in the received embroidery data. The user may then create the pieces 56A and 56B by cutting the object to be sewn, on the basis of the sewn outline patterns. That is, the sewing machine 3 may create the pieces 56A and 56B using another sewing machine instead of with the cutting device 4.

The sewing machine 3 may send the embroidery data directly to the cutting device 4 without sending the embroidery data to the server device 2. In this case, the sewing machine 3 may determine whether communication with the cutting device 4 is possible instead of determining whether communication with the server device 2 is possible in step S27. Also, the sewing machine 3 may determine whether communication with the cutting device 4 is possible by the processing in step S27 (step S37), and if it is determined that communication is possible, the sewing machine 3 may send the embroidery data to the cutting device 4. Also, the sewing machine 3 may store the embroidery data in USB memory or the like, not shown in the drawings. The user may connect the USB memory or the like on which the embroidery data was stored by the sewing machine 3 to the cutting device 4. The cutting device 4 may acquire the embroidery data stored in the USB memory, and cut the pieces 56A and 56B.

The sewing machine 3 may receive an operation by the user selecting some portion of the embroidery pattern 5 displayed on the display portion 34, instead of receiving an operation by the user selecting the selection buttons 60B, 60R, and 60G. The sewing machine 3 may receive the selected portion and select a partial pattern that includes the received portion.

If the sewing order of the embroidery data is set on the basis of (1), the sewing machine 3 may set the sewing order of the sewing based on the first sewing data and the second sewing data such that the sewing of the positioning markers 57A and 57B and the stitch 58 is performed before the sewing of one of the partial patterns 51 or 53. If the sewing order of the embroidery data is set on the basis of (2), the sewing machine 3 may set the sewing order of the sewing based on the first sewing data such that the sewing timing of the stitch 58 sewn instead of the partial patterns 52 is the same as the sewing timing of the partial patterns 52 when the partial patterns 51 to 53 are sewn. The sewing machine 3 may generate only the first sewing data to sew the stitch 58, and not generate the second sewing data to sew the positioning markers 57A and 57B. The sewing machine 3 may receive the sewing type of the stitch 58, and sew the stitch 58 on the basis of the received sewing type. If a crossover thread is included between the partial patterns 52A and 52B, the sewing machine 3 may identify the outlines L including the crossover thread, and generate processing data.

The sewing machine 3 generates one piece of processing data for performing processing following the shape of each of the partial patterns 52A and 52B that have sewing thread of a common thread color. In contrast, the sewing machine 3 may alternatively generate processing data corresponding to the partial pattern 52A, and processing data corresponding to the partial pattern 52B separately (step S21). In this case, when the cutting device 4 processes the object 40 to be cut on the basis of the processing data, the sewing machine 3 can cause the cutting device 4 to cut the pieces 56A and 56B separately.

Figures 12A, 12B, 12C:
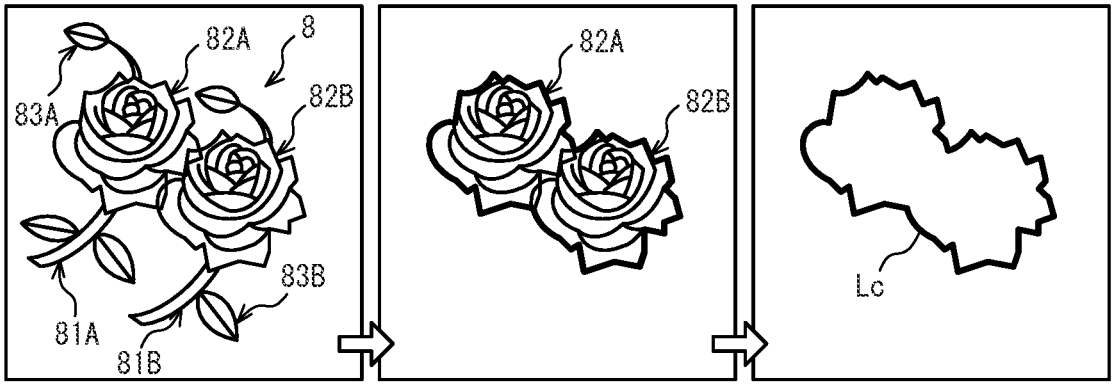
FIG. 12A to FIG. 12C are views of an embroidery pattern and an outline.

An embroidery pattern 8 illustrated in FIG. 12A has partial patterns 81A, 81B, 82A, 82B, 83A, and 83B. The partial patterns 81A and 81B (stem portions) are sewn using brown sewing thread. The partial patterns 83A and 83B (leaf portions) are sewn using green sewing thread. The partial pattern 82A (petal portion) is sewn using red sewing thread. The partial pattern 82B (petal portion) is sewn using pink sewing thread. The embroidery pattern 8 illustrated in FIG. 12A differs from the embroidery pattern 5 illustrated in FIG. 2A in that the thread colors of the sewing threads used to sew each of the partial patterns 82A and 82B are different, and portions of each of the partial patterns 82A and 82B overlap with each other.

A case will be presumed in which the user has performed an operation to select the selection button 60R in order to select the color red as the thread color. The CPU 31 receives the selection of the color red via the input portion 35, and selects the partial pattern 82A corresponding to the color red (step S13; refer to FIG. 9). Here, the CPU 31 may further select the partial pattern 82B that overlaps with the selected partial pattern 82A, as illustrated in FIG. 12B. The CPU 31 may then identify, on the basis of the embroidery data, the outline Lc of a region occupied by at least one of the partial patterns 82A and 82B that partially overlap with each other, as illustrated in FIG. 12C (step S19; refer to FIG. 9). In this case, the sewing machine 3 may generate processing data for collectively cutting the partial pattern 82A selected by the user and the partial pattern 82B that overlaps with part of the partial pattern 82A.

The sewing machine 3 has set the prohibit flag "1" for the needle drop coordinate data of the partial patterns 52 in the embroidery data D2 such that the selected partial patterns 52 will not be sewn (step S33). On the other hand, the sewing machine 3 may alternatively prohibit the prohibit flag "1" from being set by the processing in step S33, in response to a setting change command received from the user. That is, the sewing machine 3 may sew the selected partial patterns 52.

The sewing machine 3 may set the prohibit flag "1" for the processing data in the embroidery data D2 such that sewing based on the processing data will not be performed regardless of whether communication with the server device 2 is possible. Also, the sewing machine 3 need not perform the setting process of the prohibit flag according to whether communication with the server device 2 is possible, but may instead set the prohibit flag "1" for the processing data in the embroidery data D2 if embroidery data has been sent to the server device 2 by the processing in step S39.

The preview image 70 may include an image showing the positioning markers 57A and 57B, and an image showing the stitch 58. The color of the substitute images 72A and 72B can be changed by the user's setting.

The user may select a plurality of selection buttons when the selection buttons 60B, 60R, and 60G illustrated in FIG. 10 are displayed on the display portion 34. For example, when the selection buttons 60B and 60R are selected, the sewing machine 3 may identify the outlines of the partial patterns 51A to 51D (refer to FIG. 2B) to be sewn with brown sewing thread corresponding to the selection button 60B, and the outlines of the partial patterns 52A and 52B (refer to FIG. 2C) to be sewn with red sewing thread corresponding to the selection button 60R. The sewing machine 3 may generate, all at once, processing data for cutting pieces corresponding to the partial patterns 51A to 51D, 52A, and 52B, on the basis of the identified outlines.

The sewing machine 3 generates, for each thread color, one piece of processing data corresponding to the plurality of partial patterns 50 that have sewing thread of a common thread color. Therefore, as described above, when the selection buttons 60B and 60R are selected, one piece of processing data corresponding to the partial patterns 51A to 51D to be sewn with brown sewing thread is generated, and one piece of processing data corresponding to the partial patterns 52A and 52B to be sewn with red sewing thread is generated.

The sewing machine 3 may set the sewing order in the embroidery data D2 such that the sewing order corresponding to the processing data, the first sewing data, and the second sewing data comes after the sewing order corresponding to the needle drop coordinate data for sewing the partial patterns 51, but before the sewing order corresponding to the needle drop coordinate data for sewing the partial patterns 53. Also, the sewing machine 3 may set the sewing order in the embroidery data D2 such that the sewing order corresponding to the processing data, the first sewing data, and the second sewing data comes after the sewing order corresponding to the partial patterns 51 to 53.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A non-transitory computer readable storage medium storing computer readable instructions that are executed by a processor, the computer readable instructions causing the processor to perform processes comprising:

an acquisition process to acquire embroidery data of an embroidery pattern formed from a plurality of partial patterns, the embroidery data prescribing a sewing order for each of the plurality of partial patterns;

a selection process to select, as a selected partial pattern, at least one partial pattern from among the plurality of partial patterns forming the embroidery pattern, on a basis of the embroidery data acquired by the acquisition process;

an identification process to identify, on a basis of the embroidery data, an outline of the selected partial pattern selected by the selection process;

a first generation process to generate processing data for performing processing following a shape of the selected partial pattern, on a basis of the outline identified by the identification process;

a second generation process to generate, on the basis of the outline, first sewing data for sewing on a piece having the shape of the selected partial pattern; and a first setting process to set the sewing order such that sewing based on the first sewing data is performed before at least one first other partial pattern other than the selected partial pattern, from among the plurality of partial patterns, is sewn.

2. The non-transitory computer readable storage medium according to claim 1, wherein the acquisition process acquires the embroidery data of the embroidery pattern formed from the plurality of partial patterns in which the embroidery pattern is divided by thread color which is a color of thread used to sew the embroidery pattern, and when a selection of the thread color is received, the selected partial pattern selected by the selection process corresponds to the selected thread color.

3. The non-transitory computer readable storage medium according to claim 2, wherein the selection process selects, as the selected partial pattern, two or more partial patterns, the identification process identifies the outline of each of the two or more partial patterns selected by the selection process, and the first generation process generates, for each partial pattern in which the thread color is the same, the processing data for performing the processing following the shape of each of the two or more partial patterns, on the basis of the outline identified by the identification process.

4. The non-transitory computer readable storage medium according to claim 1, wherein the first setting process sets the sewing order of the embroidery data such that the sewing based on the first sewing data is performed (i) in an order in which the selected partial pattern is sewn, or (ii) before the selected partial pattern is sewn.

5. The non-transitory computer readable storage medium according to claim 1, wherein the second generation process further generates, on the basis of the outline, second sewing data for sewing a marker indicating a position where the piece is to be sewn on, and the first setting process sets the sewing order of the embroidery data such that sewing based on the second sewing data is performed before the sewing based on the first sewing data is performed.

6. The non-transitory computer readable storage medium according to claim 1, wherein the computer readable instructions cause the processor to perform processes further including a second setting process to set the sewing order of the embroidery data such that other sewing based on the processing data is performed before a second other partial pattern other than the selected partial pattern, from among the plurality of partial patterns, is sewn.

7. The non-transitory computer readable storage medium according to claim 1, wherein the computer readable instructions cause the processor to perform processes further including a first determination process to determine whether a crossover is included in the selected partial pattern selected by the selection process, and the identification process identifies the outline of a portion of the selected partial pattern other than the crossover in a case where the first determination process determines that the crossover is included.

8. The non-transitory computer readable storage medium according to claim 1, wherein the selection process selects, as the selected partial pattern, two or more partial patterns, the identification process identifies the outline of each of the two or more partial patterns selected by the selection process, and the first generation process generates, on the basis of the outline identified by the identification process, the processing data for performing the processing following the shape of each of the two or more partial patterns.

9. The non-transitory computer readable storage medium according to claim 1, wherein the first generation process separately generates, for each of two or more partial patterns, the processing data for performing processing following the shape of each of the two or more partial patterns.

10. The non-transitory computer readable storage medium according to claim 1, wherein the identification process identifies, on the basis of the embroidery data, the outline of a region occupied by the selected partial pattern, or at least one of an overlapping partial pattern which is a second other partial pattern other than the selected partial pattern, from among the plurality of partial patterns, and which overlaps with the selected partial pattern.

11. The non-transitory computer readable storage medium according to claim 1, wherein the computer readable instructions cause the processor to perform processes further including a third setting process to set the embroidery data such that the selected partial pattern selected by the selection process, of the embroidery pattern, is not sewn.

12. The non-transitory computer readable storage medium according to claim 1, wherein the computer readable instructions cause the processor to perform processes further including a second determination process to determine whether communication with an external device is possible; and a fourth setting process to set the embroidery data such that another sewing based on the processing data generated by the first generation process is performed in a case where the second determination process determines that communication with the external device is not possible, and set the embroidery data such that the other sewing based on the processing data generated by the first generation process is not performed in a case where the second determination process determines that communication with the external device is possible.

13. The non-transitory computer readable storage medium according to claim 1, wherein the computer readable instructions cause the processor to perform processes further including a display process to display a preview image on a display portion, and the preview image is an image in which the selected partial pattern selected by the selection process, of the embroidery pattern, is replaced with a substitute image.

14. A sewing machine sewing an embroidery pattern onto an object to be sewn, the sewing machine comprising:

a processor; and a memory configured to store computer readable instructions that, when executed by the processor, instruct the processor to perform processes including acquiring embroidery data of the embroidery pattern formed from a plurality of partial patterns, the embroidery data prescribing a sewing order for each of the plurality of partial patterns;

selecting, as a selected partial pattern, at least one partial pattern from among the plurality of partial patterns forming the embroidery pattern, on a basis of the acquired embroidery data;

identifying, on a basis of the embroidery data, an outline of the selected partial pattern that was selected;

generating processing data for performing processing following a shape of the selected partial pattern, on a basis of the identified outline;

generating, on the basis of the outline, first sewing data for sewing on a piece having the shape of the selected partial pattern; and setting the sewing order such that sewing based on the first sewing data is performed before at least one first other partial pattern other than the selected partial pattern, from among the plurality of partial patterns, is sewn.

* * * * *